US006820449B2

(12) United States Patent
Seifert et al.

(10) Patent No.: US 6,820,449 B2
(45) Date of Patent: Nov. 23, 2004

(54) APPARATUS FOR FABRICATING A HOLLOW BODY

(76) Inventors: Michael Seifert, Crinitztalstrasse 102, D-08147 Obercrinitz (DE); Thomas Werle, Franz-Martin-Strasse 14, D-51789 Lindlar (DE)

( * ) Notice: Subject to any disclaimer, the term of this patent is extended or adjusted under 35 U.S.C. 154(b) by 0 days.

(21) Appl. No.: 10/012,583

(22) Filed: Dec. 10, 2001

(65) Prior Publication Data

US 2002/0042980 A1 Apr. 18, 2002

Related U.S. Application Data

(62) Division of application No. 09/075,980, filed on May 11, 1998, now Pat. No. 6,418,607.

(30) Foreign Application Priority Data

May 12, 1997 (DE) ..... 197 19 426

(51) Int. Cl.[7] ..... B21D 39/00
(52) U.S. Cl. ..... 72/57; 72/58
(58) Field of Search ..... 29/421.1, 509, 29/514, 524; 72/55, 57, 58, 60, 61

(56) References Cited

U.S. PATENT DOCUMENTS

| | | | | | |
|---|---|---|---|---|---|
| 5,157,969 | A | * | 10/1992 | Roper | 72/60 |
| 5,214,948 | A | * | 6/1993 | Sanders et al. | 72/58 |
| 5,372,027 | A | * | 12/1994 | Roper et al. | 72/60 |
| 5,398,533 | A | * | 3/1995 | Shimanovski et al. | 72/55 |
| 5,540,075 | A | * | 7/1996 | Hall, Jr. | 72/60 |
| 5,666,840 | A | * | 9/1997 | Shah et al. | 72/55 |
| 5,813,266 | A | * | 9/1998 | Ash | 72/57 |
| 5,816,089 | A | * | 10/1998 | Marando | 72/55 |
| 6,052,887 | A | * | 4/2000 | Dziadosz et al. | 29/509 |

* cited by examiner

*Primary Examiner*—Gregory Vidovich
*Assistant Examiner*—Jermie E. Cozart
(74) *Attorney, Agent, or Firm*—Sidley Austin Brown & Wood, LLP

(57) ABSTRACT

An apparatus for making hollow bodies, preferably components made from blanks, includes a press table, a slide movable upwardly and downwardly relative to the press table, a tool upper part connected to the upwardly and downwardly movable slide for joint movement therewith; a two-part tool lower part fixed on the press table, and additional tools integrated in the apparatus.

14 Claims, 4 Drawing Sheets

APPARATUS FOR FABRICATING A HOLLOW BODY

RELATED APPLICATIONS

This application is a division of application Ser. No. 09/075,980 filed May 11, 1998, now U.S. Pat. No. 6,418,607.

FIELD OF THE INVENTION

The invention relates to a method and apparatus for fabricating a hollow body, preferably from sheet metal, such as, for example, an automobile hood, door or the like, wherein the so-called internal hydroforming (IHF) (high pressure forming) process is applied.

BACKGROUND AND PRIOR ART

German Offenlegungsschrift 42 32 161 describes a method for fabricating a hollow body starting from a body made from blanks, wherein the hollow body is fabricated by the combined use of the IHF process and the deep drawing process. The distinctive feature of this proposed method is that the initial workpiece is first fabricated from two blanks having identical edge dimensions, which are placed upon one another and welded together at the edges. After placing the initial workpiece in a press die and closing the die, the forming of the starting body to a hollow body takes place by the above-mentioned process. When the forming process is complete, further processing steps follow.

Apart from the fact that in this proposed method an initial workpiece has to be separately fabricated and then placed in the press die-which requires at least two additional process steps-this method suffers from the disadvantage that because of the weld bead only workpieces which are symmetrical in respect of their upper and lower parts can be fabricated.

Moreover in the border region of the component the hollow body must be further treated after the forming on account of surface damage by the deep drawing: this is followed by still further processing steps such as, for example, cropping of the wide flanges caused by the type of forming and/or post-spot welding of the connection between the blanks, which must be done in further separate work stations. The method is thus distinguished by requiring numerous processing steps which must be carried out in succession, and is extremely limited in respect of its product range.

OBJECT OF THE INVENTION

Against this background, it is the object of the invention to provide a method of fabricating a hollow body which, having regard to the constantly growing pressure on time and costs, particularly in the automobile industry, is more efficient and thus more economical and is also more adaptable.

SUMMARY OF THE INVENTION

In accordance with the invention, this object is achieved by a method of fabricating a hollow body such as, for example, an automobile hood, door or the like, in which at least two blanks, preferably consisting of sheet metal, are held sealingly together along an at least almost completely closed line, the hollow body is shaped by means of the internal hydroforming (IHF) process, and the mutually connected blanks are clinched together.

The method is also particularly suitable for the fabrication of multi-walled components which are specially suitable for bodywork, such as, for example, automobile hoods and doors, tail gates and roofs, and can advantageously be carried out in only a single tool.

After cutting the starting blanks to shape they are placed in a special internal hydroforming (IHF) tool, to be described later, held sealingly together in their border regions, and then shaped into a hollow body by means of the internal hydroforming (IHF) process. For stabilisation and final connection of the blanks these are clinched at suitable places. These manufacturing steps-holding sealingly, forming and clinching-can, according to the invention, be carried out with considerable advantage in only a single tool and in almost any desired order, as well as in combination.

The terms "hold sealingly together" or "holding sealingly" herein are to be understood as meaning a sealing together of the two blanks which makes it possible to apply the IHF process at least without any significant amount of pressure medium being able to escape to the exterior as the cavity or cavities between them is or are created. This can be achieved, for example, by the application of adhesive strips between the blanks, by edge forming of the flange regions of the blanks, or by a combination of the two. During the forming the flange regions or the sealing line or lines can also be subjected by suitable means, through suitable shaping of the tool, to a pressure sufficient for sealing. The pressure tightness is thus obtained by form-fitting. If the sealing pressure (pressing force applied along the sealing line) is adequate, the blanks are, in addition, cold welded, at least in some places: while this is not essential for the method in accordance with the invention, it is nevertheless advantageous.

In an embodiment of the invention the blanks are plastically worked by pressing, preferably in the edge fold corner region: this leads to reliable sealing. For this purpose the tool-as described in more detail below-is modified by providing an additional draw ring as part of the lower draw punch.

In another embodiment of the invention at least one further processing step is performed in the special IHF tool during, in combination with and/or after the IHF process. These processing steps include, for example, stamping, punching and sealing, as well as at least preparations for the fitting of [tasteriers] and the like.

For completeness it should be mentioned at this point that components from other branches of industry, such as, for example, flat radiators or similar articles, can also be fabricated using the method of the invention.

BRIEF DESCRIPTION OF THE DRAWINGS

By way of example, preferred variants of the method in accordance with the invention will be described in more detail below with reference to the embodiments shown in the drawings, in which.

DETAILED DESCRIPTION OF PREFERRED EMBODIMENTS OF THE INVENTION

Figure 1:
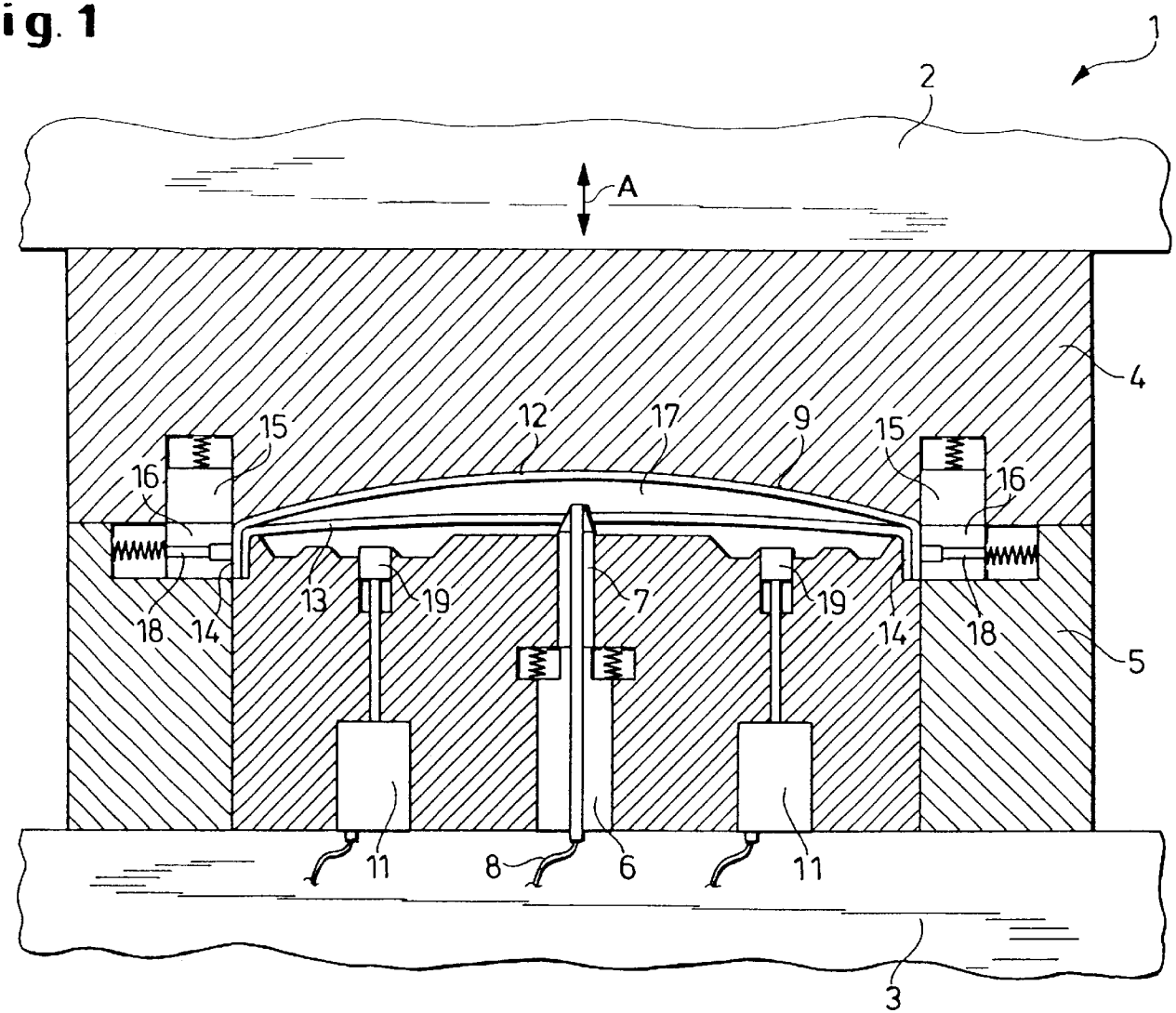
FIG. 1 is a cross-section through a preferred embodiment of an IHF tool.
Figure 2:
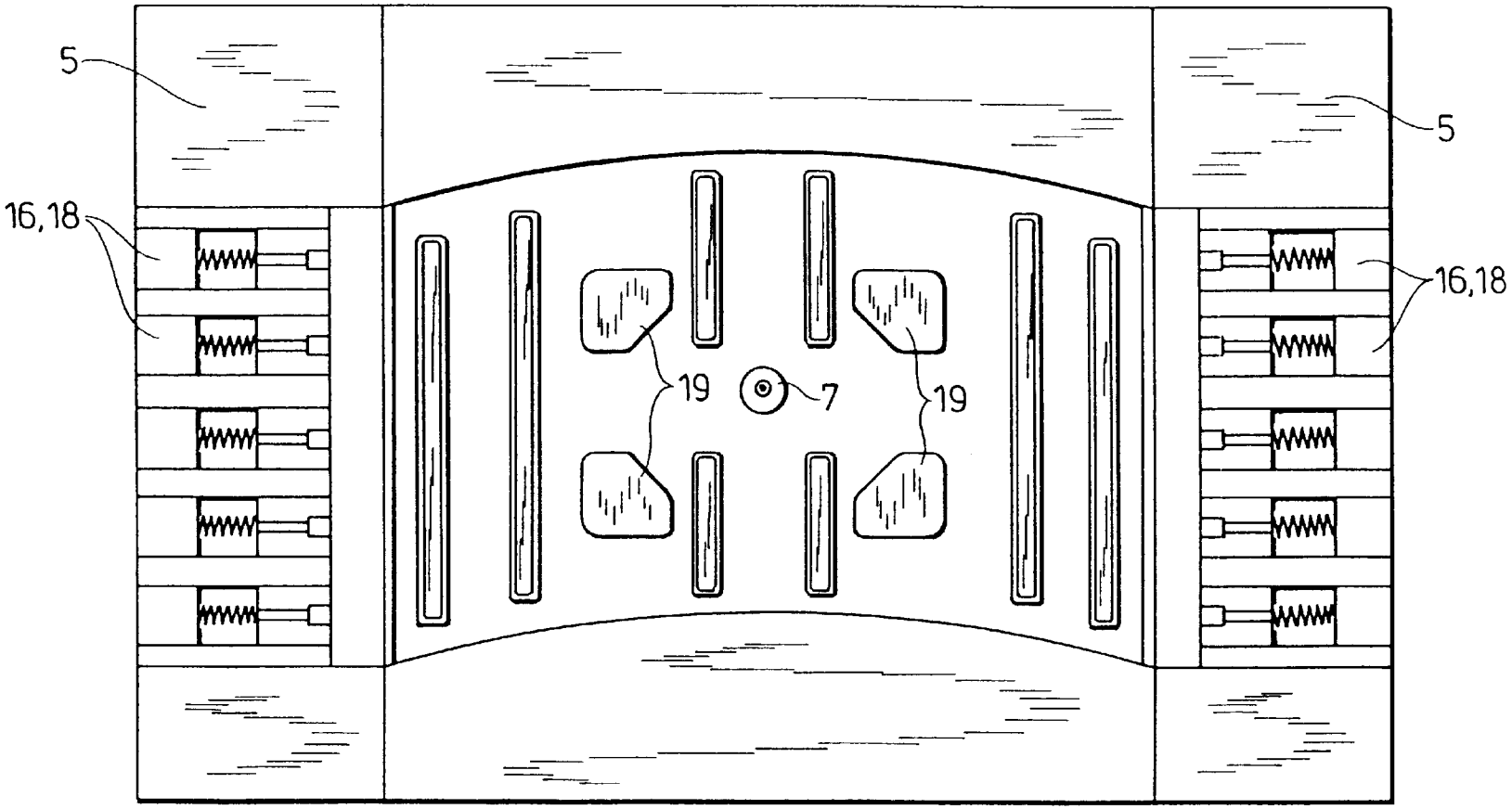
FIG. 2 is a plan view of the lower part of the IHF tool shown in FIG. 1, incorporating auxiliary tools in accordance with the invention.

The method in accordance with the invention will be described by way of example with reference to the fabrication of an automobile hood. FIG. 1 shows a special internal hydroforming (IHF) tool 1, namely an internal sheet metal hydroforming (ISHF) tool compromising a slide 2 and a press table 3. The slide 2 can be moved vertically up and down as shown by the arrow A. On its underside the slide carries an upper tool part 4. The associated lower tool part 5 is correspondingly fixed on the press table 3. When the IHF tool is closed, the upper tool part 4 and the lower tool part 5 form the negative mold of the hollow body, i.e., the boundary surface against which the hollow body, which is to be fabricated by the IHF process, is pressed and from which it obtains its final, exactly reproducible shape. This negative mould could be made up of movable counter-pressure parts for shaping the hollow body to be fabricated in different ways.

Further integrated in the IHF tool 1 there is a pressure medium supply docking system 6 as a kind of docking system, which includes a lance 7 and a connection 8 with a pressure medium reservoir (not shown). In this embodiment the docking system 6 is installed in the lower part 5 of the tool in such a way that its lance 7 can be moved towards the hollow body 9 to be fabricated and a constant supply of pressure medium is ensured through the connection 8. The docking system 6 could also be arranged between the upper part 4 and the lower part 5 of the tool: the supply of medium into the hollow body 9 would then take place from the side.

To perform further processing steps in the same IHF tool 1 it is possible to integrate in the tool additional time controlled and suitably spatially associated tools such as, for example, stamping tools 11 for forming perforations and/or larger apertures in the hollow body. These openings can, for example, be used for the introduction of fasteners, for running cables and, in the case of components to receive fluids, for the inflow and outflow of the fluids. Large apertures are suitable for the improvement of the vibrational properties.

In an advantageous embodiment, the method in accordance with the invention for fabricating hollow bodies from blanks is carried out using the following steps:

First the sheet metal starting blanks-in the case of an automobile hood these can be an outer skin blank 12 and an inner carcase blank 13—are cut to size on a coil-handling machine and if possible the front and back ends-referring to the automobile hood being fabricated-of the outer skin blank 12 are bent over at an angle greater than 90°. The reason for the bending over at an angle greater than 90° is explained below. If this bending step cannot be integrated in the coil handling equipment, edge forming in a preforming tool after the cutting to size is possible. Before being placed in the IHF tool 1 the blanks 12, 13 which are to be connected together can be prefixed by means of adhesive strips on the inside of the outer skin blank 12, on the edge formed front and back surfaces. These adhesive strips serve, beside the prefixing function, to seal the blanks together and to absorb vibrations and to avoid corrosion between the blanks.

As soon as the inner carcase blank 13 has been placed in the outer skin blank 12 and they have both been placed in the IHF tool 1, this is closed by lowering the slide 2. In doing so the bent-over front and back surfaces of the outer skin blank 12 are automatically edge formed, since they have already been bent over by more than 90°, so that after closure of the tool they firmly embrace the flanks of the front and back of the inner carcase blank 13. At the same time the side flanks 14 of both blanks 12, 13 are bent down—preferably by more than 90°—by the application of a certain feeding force by upwardly and downwardly movable punches 15 mounted in the upper part 3 of the tool, and then, by means of horizontally movable raillike punches 16 extending along the whole length of the rim and integrated in the lower part 5 of the tool, are pressed together so hard that the blanks 12, 13 are held together along their whole length so tightly that no forming medium can escape. In so doing partial or complete cold welding may even take place. On the end faces of the hollow body 9, which have been edge formed during or by the advance of the slide 2, the edge forming serves to provide the necessary pressure tightness. It should be mentioned at this point that flanging in the IHF tool 1 can also take place along a closed line-i.e. along the whole of the outer flanks. Another possibility is to flange the whole of the flanks before placing the blanks in the 5 IHF tool 1 and to edge form them by lowering the slide 2.

In this way the blanks 12, 13 are held sealingly together along their border surfaces, so that during the following internal hydroforming no pressure medium can escape from the cavity 17 between the blanks 12, 13 and so that the high pressure needed for the shaping can build up in the hollow body. Rubber edge trim can be pushed on to the laterally flanged flanks 14 after the fabrication process to protect the gutters in the front region of the automobile.

In addition, during the closing of the IHF tool 1 the lance 7 of the docking system 6 is moved towards the inner carcase blank 13. By means of the lance 7 the pressure medium is delivered into the cavity 17 between the blanks 12, 13 during the internal hydroforming, and a high internal pressure in built up. For this purpose it is necessary to pierce one of the two blanks 12, 13, which are held sealingly together, with the lance 7, unless a pressure medium inlet opening has already been provided in one of the blanks 12, 13 or in the border region between them. However, it is important to avoid piercing both of the blanks 12, 13, since otherwise the pressure tightness necessary for building up a high internal pressure will not exist.

There are various possible ways of piercing one of the blanks 12, 13. One which may be mentioned is the application of suction to the blank through which the lance 7 of the docking system 6 is to penetrate by means of a "feeder": the superimposed blanks 12, 13 are thereby drawn apart and piercing of both blanks 121, 13 is avoided.

If because of the geometry of the component to be fabricated the formation of this passage opening should not be possible, then before the blanks 12, 13 are connected together, for example during the cutting to size on the coil handling equipment, a hole must be formed at the position on the blank where the pressure medium supply 6 in the IHF tool is located 5 after insertion of the blank.

The lance 7 is formed in such a way that no pressure medium can escape from the hollow body during the forming. This is achieved, for example, by means of a conical lance end.

As soon as the IHF tool 1 has been closed and the front and back end surfaces thereby clinched, and also the side flanks 14 of the blanks 12, 13 have been pressed together and the docking system 6 has been connected to the workpiece, the forming medium is delivered into the internal cavity 17 of the hollow body 9 between the blanks 12, 13. Forming media which come into consideration include both fluids and also gases and foams: for particular applications the latter can remain in the hollow body after completion of the forming process, since they have a favourable effect on the damping or vibrational properties of the whole component.

As a result of the penetration of the forming medium into the internal cavity 17 and the building up of the pressure the shaping takes place, and so, when the maximum pressure is reached, does the final sizing (e.g. forming of fine corner radii) of the blanks 12, 13 into their final form.

At this point it should be mentioned that it is important for the subsequent quality of the component that during the forming process no deep drawing takes place in the region of the joints between the blanks 12, 13, in this case in the region of their end borders and side flanks 14, because of the clamping action which is maintained while the tool is closed. This is a particular advantage of the invention, since consequently no flow of material occurs in these regions which would adversely affect the properties of the component, particularly its surface quality.

By means of the process of the invention it is possible in a time and cost-saving manner to carry out further processing steps on the hollow body both during and also in combination as well as after completion of the internal high pressure forming. These additional working steps are advantageously carried out in the IHF tool 1, thus dispensing with removal and renewed insertion in a further tool.

These processing steps include the clinching of the flanks 14 to connect the blanks 12, 13 by means of individual punches 18, which are mounted in the horizontally movable rail punch 16 and can likewise be moved horizontally relative thereto, and also, for example, punching operations in the outer skin blank 12 and/or in the inner carcase blank 13, as well as the introduction of relatively large apertures in the inner carcase blank 13, the function of which has been explained above.

The punching process can be carried out in various ways. Examples which may be mentioned here are "inward" punching, "outward" punching and punching "with the slug remaining on the component". In the case of "inward" punching, during or after the internal hydroforming the punching or cutting tool moves with its punch end 19 into the hollow body while this is subjected to high pressure, remains there during the forming and thereby prevents an escape of the pressure medium. The stamped-out slugs then remain inside the hollow body.

"Outward" punching takes place in two steps. In a first step the punching or cutting tool 19 moves against the hollow body during the IHF process and penetrates into its wall far enough to produce a break-off line. In the second step the tool 19 is suddenly withdrawn at high speed at maximum internal high pressure. The material of the blank breaks along the break-off line and is forced outwards as a slug. While there is some escape of pressure medium, and thus a drop in pressure in the hollow body, this is negligible.

In punching "with the slug remaining on the component" the punching or cutting tool is made blunt at one point on the stamping edge, so that a connection remains in part of the hole region, whereby the stamped-out slug is folded over inwards and remains connected to the blank and thus does not remain loose in the hollow body. The stamping end of the punching or cutting tool can be left in the hollow body until the internal high pressure is again released. Moreover the slugs which are left behind in this way do not cause any problems in painting, since it is possible to apply paint in the vicinity of the foldedover slug since the slug is not folded so far as to come up against the inner surface of the wall.

As soon as all the processing steps have been completed, the forming medium is sucked out of the internal cavity 17 of the component-unless, in the case of the use of foam as pressure medium, this is to remain in the workpiece for the reasons given above-and from the IHF tool, either through the pressure medium supply means 6 or through a further special integrated device, not shown here.

After opening the IHF tool a complete finished component is present, to which it is only necessary to affix holders to receive fasteners (so far as these are required) by rivetting or spot welding and to screw on the locking mechanism.

In FIGS. 3 to 7, a particularly preferred embodiment of the invention is shown which, while it corresponds in its essential construction to that described above, nevertheless introduces particular advantages by changes in some details, namely on the one hand an optimised sealing at the connecting regions of the blanks and on the other hand a stationary docking system which is simpler than the embodiment described above.

Figure 3:
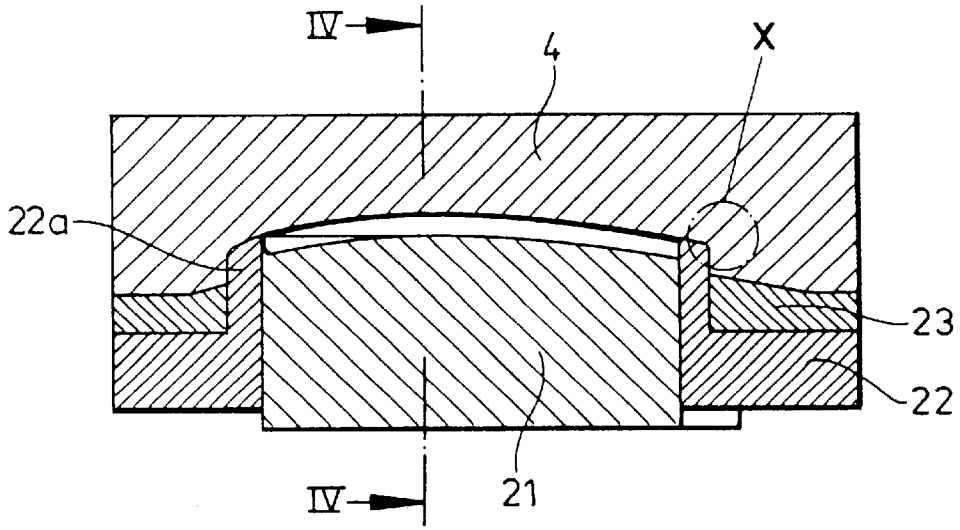
FIG. 3 is a cross-section through a particularly preferred embodiment, taken along the line 111—111 in FIG. 4.

The optimised sealing is achieved in this embodiment, according to the invention, by producing a seal edge in the corner of the edge fold (see also FIG. 6), namely at the transition from the so-called "frame" that is the bent-down region of the sheet or blank, which in the drawings runs vertically downwards) to the hollow body proper (in this case, the engine hood). This eliminates flanging or edge folding of the blanks before they are placed in the IHF tool for the production of the side flanks 14—instead, this region is correspondingly formed during the closing of the tool-and the punches 15, 16 and 18. This means a considerable saving in constructional cost and substantially simplifies the tool in respect both of its construction and of its additional operating devices. This is achieved by means of a change in the form both of the lower part 5 of the tool and of the upper part 4 of the tool which, as FIG. 3 shows, is drawn down laterally over the centre piece of the lower part of the tool, which in turn is divided into a central, movable draw punch 21 and a surrounding draw ring 22. Between the draw ring 22 and the upper part or matrix 4 of the tool there is a hold-down device 23 which in addition surrounds the outside of an upwardly projecting, collar-like section 22*a* (see also FIGS. 3 and 4) which likewise surrounds the movable draw punch.

Figure 6:
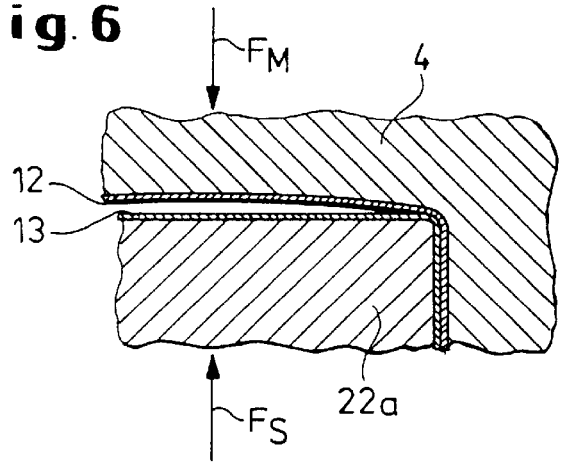
FIG. 6 shows the detail X from FIG. 3, enlarged to clarify the region of the cold welding of the blanks.

FIG. 6 shows in the circle the region of the cold welding of the blank which occurs through the cooperation of the force FS of the draw ring 22 and the matrix force FM when the tool is closed. This eliminates the need for the hydraulic pressing-in, provided in the embodiment described previously, of the "frame" from the side by means of the hydraulic cylinders and the bending down or edge folding before placing the blanks in the IHF tool, or alternatively the flanging in the tool by means of the punches 15, since this procedure takes place automatically on closing the tool after the previously described insertion of the workpiece (blanks), resulting in the cold welding. At the same time this brings the further advantage that no specific associations of the regions in the sheet which have been preformed before the insertion into the tool are now needed, which in the embodiment previously described was a condition for a reliable sealing of the sheets to one another.

This corner welding obtained in the embodiment described herein, which, as is shown by the directions of the forces shown in FIG. 6, is brought about from above or below and not from the side, is more pressure tight and can be produced more precisely, since otherwise a relatively large area has to be sealed. Consequently it is also possible to dispense with the use of adhesive strips for fixing the relative positions and/or with additional seals.

It must also be mentioned that because of the function of the hold-down device in closing the tool a controlled material flow in the "frame" region is achieved, which for the following reasons is of quite considerable advantage. In addition it must be mentioned with regard to the manufacturing process that in the starting position the hold-down device 23 contacts the inner blank in its border region from below, while the matrix contacts the outer blank 12 from above, and on closing the tool the border regions are clamped between the hold-down device 23 and the matrix-4 in such a way that in the subsequent blank connecting and—sealing region forming takes place downwards over the outer edge of the draw ring collar 22*a*, so that at first the border region is given a Z-shaped cross-section, namely one which runs from the region adjacent the upper end face of the collar 22*a*, over the vertical, drawn-down region between the outer surface of the collar 22*a* and the inner surface of the matrix-4, and finally to the again substantially horizontal border region clamped between the matrix-4 and the hold-down device 23.

On further downward travel of the matrix, the region clamped between the matrix-4, and the hold-down device 23 is freed, corresponding to the downward movement, until it runs completely vertically to form the frame, i.e. is formed into the vertical frame region. The extremely advantageous consequence of this is fold-free stretching over the collar 22*a*, which leads in particular to the result that because of the controlled flow of material in the sealing region, as already described, no folds can be formed and consequently the desired connection and pressure-tightness is guaranteed.

Figure 5:
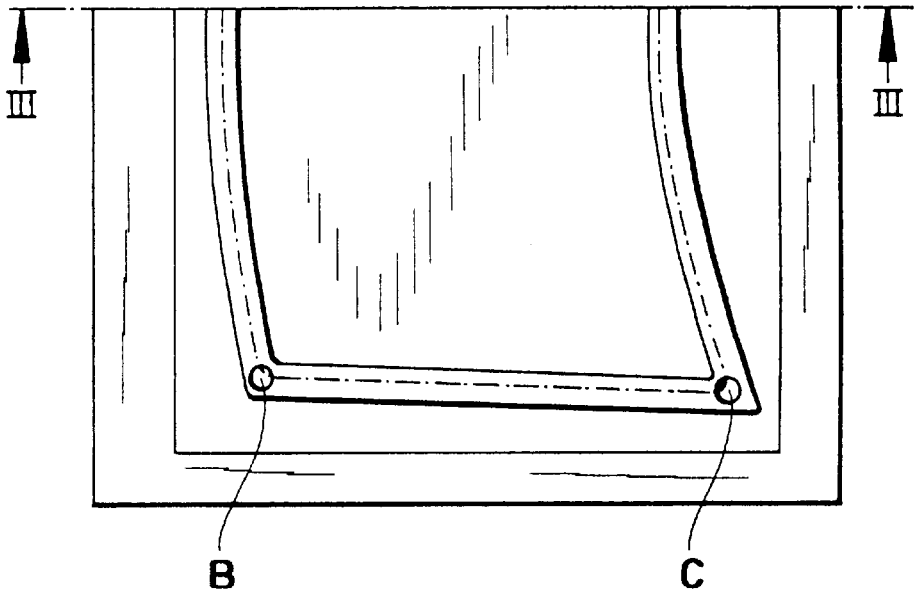
FIG. 5 is a halved plan view of the embodiment shown in FIG. 3, to clarify the position of the docking points.
Figure 4:
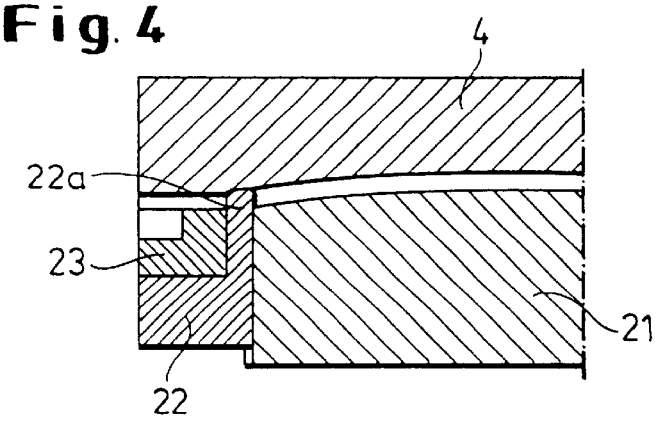
FIG. 4 is a halved cross-section through the embodiment shown in FIG. 3, taken along the line IV—IV in FIG. 3.
Figure 7:
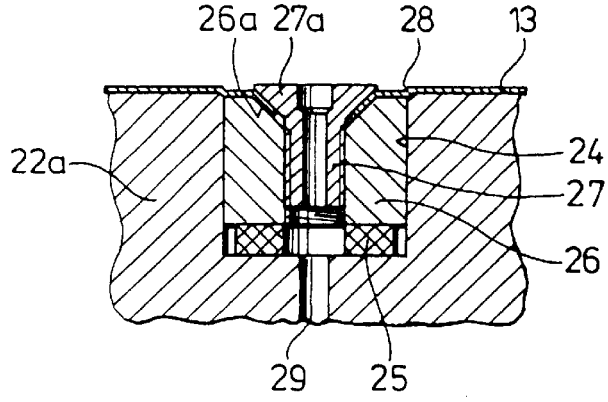
FIG. 7 shows a docking point of the stationary docking system provided for the variant shown in FIG. 3.

As already mentioned, in this embodiment the docking system used for filling and venting during the IHF process is not a mobile system but a stationary one, of which the essential features are shown in FIG. 7 and the docking positions are shown in FIG. 5. This docking system is described as stationary since it is provided in the stationary draw ring 22, in the collar 22*a* thereof, which is provided with a recess 24 in its upper end face into which a matching bushing 26 is introduced, to be yieldingly supported by suitable means 25. The bushing 26 is provided with an internal screw thread and, on its upwardly facing free end face, with a conical countersink 26*a*. After insertion of the blank (in this case the inner blank 13), which is provided with corresponding bores at the positions associated with the docking points and is at this time supported at the rim of the bores by, or is resting on, the collar 22*a*, a hollow screw 27 provided with an external screw thread and having a conically widening head 27*a* (see FIG. 7) which matches the countersink 26*a* is screwed into the bushing 26 so that the inner blank 13 is deformed in the region of the hole, as shown in FIG. 7, into a funnel shape matching the conical head 27*a* and the countersink 26*a*.

FIG. 5 shows the arrangement of two such docking points, the docking point B being used for venting and the docking point C for filling the cavity formed between the two blanks, which in this region, as shown in FIG. 6, is formed by the space between the blanks, with one of the pressure media referred to.

After screwing up the inner blank 13 at the docking points and laying on the outer blank, the tool is closed, with the result that, through the action of the hold-down device 23, the controlled flow of material referred to and plastic deformation of the sealing edge (see FIG. 6) occur. The cavity is now filled through the docking system with water or the like pressure medium at about 10 to 50 bar, whereby, through the internal pressure in the region of the docking points an embossed edge 28 is formed at the transition between the recess 24 and the collar 22*a* of the draw ring because of the yielding mounting of the bushing through the component 26. Before the internal pressure is applied the movable draw punch 21 is moved towards the matrix as far at its end position, so that through the internal pressure the final geometry of the engine hood or like workpiece and the said shape of the embossed edges in the region of the docking points are formed. After the final shape has been obtained the tool is opened and the engine hood or like workpiece is removed, thereby tearing the docking system out of the inner blank along the embossed edges, since the embossed edges 28 then act as shearing edges. Finally, by removal of the hollow screws, 27, the sheet portions of the inner blank which have been formed into a funnel shape and are held between the hollow screws 27 and the bushings 26 can be removed.

As the preceding explanations show, this docking system provides a means for supplying the pressure medium which is both effective and at the same time of extremely simple design, and it should not be overlooked that in the case of this stationary docking system each filling branch 29, which for example is connected in the manner shown in FIG. 7 to the cavity in a hollow screw 27, which in turn opens into the cavity formed between the two or more blanks, is connected to one reservoir of medium.

Using the method of the invention it is possible to process sheets of a very wide variety of dimensions, surface treatments and/or types of steel, including so-called "tailored blanks" as well as sandwich sheets. When using anticorrosion dip coated or painted blanks yet another processing step is eliminated, namely the subsequent painting.

Another possibility is to produce the individual parts of the hollow body conventionally by deep drawing and then use the method of the invention to join them to further blanks and finally size them.

Altogether by the use of the invention numerous important advantages are thus obtained for the production of components, particularly those of large area.

As a result of the use of the IHF process in the production of hollow bodies the shape change distribution and cold work hardening are uniform over the whole component, which has a favourable effect on the surface quality, dimensional accuracy, improvement of the resilience properties and-which is of particular importance in the case of large skin parts-the resistance to hail strikes. Because of the integration of numerous processing steps in one tool and the partial temporal superposition of the working steps, the manufacturing time and the logistical outlay are considerably reduced. The capital costs are lower owing to the saving in manufacturing plant (for example joining devices), and the time required for development and production of the tool is shortened. In particular for automobile hoods or the like "external parts" the contact-or friction-free forming has a favourable effect on the quality of the outer surfaces, quite apart from the fact that tool wear is minimised.

What is claimed is:

1. Apparatus for making hollow bodies, preferably components constructed from blanks, comprising a press table; a slide movable upwardly and downwardly relative to the press table; a tool upper part formed as a draw matrix and connected to the upwardly and downwardly movable slide for joint movement therewith; a two-part tool lower part fixed on the press table; additional tools integrated in the apparatus; and a pressure medium supply system in the form of a docking system integrated in the tool lower part, wherein the tool lower part is laterally overlapped by the tool upper part and consists of an auxiliary tool formed as a draw ring and a draw punch guided in the draw ring.

2. Apparatus as claimed in claim 1, wherein mutually facing surfaces of the tool upper part and the tool lower part form a negative mold of a component to be produced.

3. Apparatus as claimed in claim 1, wherein the docking system has an outwardly and inwardly movable lance, and a connection to a medium reservoir.

4. Apparatus as claimed in claim 3, wherein an end of the lance is in the form of a mandrel.

5. Apparatus as claimed in claim 1, wherein the docking system is a stationary docking system having a connection to a medium reservoir.

6. Apparatus as claimed in claim 1, further comprising at least one punching device integrated in one of the tool parts.

7. Apparatus as claimed in claim 1, wherein the draw ring is provided with a collar directed towards the tool upper part.

8. Apparatus as claimed in claim 7, wherein at least one filling docking position is provided in the collar of the stationary draw ring.

9. Apparatus as claimed in claim 7, further comprising a bushing yieldingly mounted in the collar and having an internal screw thread to receive a hollow screw having a conical widening head shaped to correspond to a countersink in the bushing.

10. Apparatus as claimed in claim 9, wherein at a transition at a front end between the bushing and the draw ring collar, a blank resting thereon has an embossed edge formed as a shear edge by an internal pressure.

11. Apparatus as claimed in claim 1, further comprising at least one venting docking position and at least one filling docking position.

12. Apparatus for making hollow bodies preferably components constructed from blanks, comprising a press table; a slide movable upwardly and downwardly relative to the press table; a tool upper part connected to the upwardly and downwardly movable slide for joint movement therewith; a two-part tool lower part fixed on the press table; additional tools integrated in the apparatus; at least one auxiliary tool integrated in one of the tool parts; at least one upwardly and downwardly movable punch for flanging or edge folding provided in the tool upper part; and at least one horizontally movable pressing punch extending along the whole length of an edge of the blank and provided in the tool lower part.

13. Apparatus as claimed in claim 12, further comprising punches for clinching.

14. Apparatus as claimed in claim 13, wherein the clinching punches are mounted in the at least one horizontally movable pressing punch and are movable relative thereto.

* * * * *